US008472284B2

(12) United States Patent
Tokiwa et al.

(10) Patent No.: US 8,472,284 B2
(45) Date of Patent: Jun. 25, 2013

(54) RADIO CONTROLLED TIMEPIECE

(75) Inventors: Teruhisa Tokiwa, Kunitachi (JP); Takashi Sano, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 179 days.

(21) Appl. No.: 13/171,641

(22) Filed: Jun. 29, 2011

(65) Prior Publication Data

US 2012/0014225 A1 Jan. 19, 2012

(30) Foreign Application Priority Data

Jul. 13, 2010 (JP) ..... 2010-158351

(51) Int. Cl.
*G04C 11/02* (2006.01)

(52) U.S. Cl.
USPC ..... 368/47; 368/46

(58) Field of Classification Search
USPC ..... 368/46–47
See application file for complete search history.

(56) References Cited

U.S. PATENT DOCUMENTS

| | | | | |
|---|---|---|---|---|
| 7,492,671 | B2 * | 2/2009 | Ogasawara | 368/47 |
| 7,542,379 | B2 * | 6/2009 | Kimel et al. | 368/10 |
| 8,233,354 | B2 * | 7/2012 | Fujisawa | 368/47 |
| 2006/0187757 | A1 * | 8/2006 | Ihashi | 368/47 |
| 2007/0242569 | A1 * | 10/2007 | Inoue et al. | 368/205 |
| 2008/0186809 | A1 | 8/2008 | Ogasawara | |
| 2009/0010980 | A1 * | 1/2009 | Singh et al. | 424/409 |
| 2010/0017760 | A1 * | 1/2010 | Kapur et al. | 716/2 |

FOREIGN PATENT DOCUMENTS

| | | |
|---|---|---|
| EP | 1 892 591 A1 | 2/2008 |
| EP | 1 978 425 A2 | 10/2008 |
| JP | 2002-006066 | 1/2002 |
| JP | 2003-114288 | 4/2003 |
| JP | 2004-226131 | 8/2004 |

OTHER PUBLICATIONS

Extended European Search Report for European Application No. 11173219.4 mailed on Apr. 24, 2012.

* cited by examiner

*Primary Examiner* — Sean Kayes
(74) *Attorney, Agent, or Firm* — Turocy & Watson, LLP

(57) ABSTRACT

A radio controlled timepiece includes: a radio wave receiving section which outputs a time code signal; an indicator display section which performs a display regarding a reception condition; a level change detecting section which detects a change of a signal level of the time code signal in a predetermined detection interval in a period of 1 second; an indicator control section which controls a content of the display based on a number of times that the change of the detected signal level appears; and an interval setting section which specifies the detection interval as a whole interval of the period of 1 second during a detecting process of a synchronization point in the time code signal every 1 second, and narrows the detection interval to be a certain interval within the period of 1 second after a detection of the synchronization point every 1 second.

7 Claims, 9 Drawing Sheets

RADIO CONTROLLED TIMEPIECE

BACKGROUND OF THE INVENTION

The present invention relates to a radio controlled timepiece having a function of receiving a standard radio wave (standard time and frequency signal).

BACKGROUND ART

Conventionally, there has been developed a radio controlled timepiece which provides an indicator display indicating whether or not a radio wave condition is good when a standard radio wave is received. For example, Japanese Patent Application Laid-Open Publication No. 2002-006066 describes a radio correcting timepiece which measures a period of a falling edge of a time signal obtained from the received standard radio wave so as to determine whether or not the standard radio wave is correctly received, and makes the display indicating this state.

Japanese Patent Application Laid-Open Publication No. 2004-226131 describes a technique in which an evaluation value indicating stability of a receiving condition is generated based on a number of edges of the standard radio wave included within a predetermined time or on a detection of a change of a signal level for every predetermined period, and a received frequency is set based on the evaluation value.

There has recently been developed various data process techniques in which in order to be capable of acquiring correct time information from the standard radio wave even if the receiving environment is not so good, a radio reception is performed for a slightly long time to make various data processes. With this, the signal-to-noise ratio of the received signal is enhanced, and/or noise is effectively removed from a demodulated pulse signal, whereby a high-precise code determination is made.

On the other hand, a radio controlled timepiece has few opportunities of performing a high-load operation process in a most period other than the time of receiving the standard radio wave. Thus, it is not economic that an operation process circuit having high processing power is mounted only for the receiving process of the standard radio wave. Therefore, an operation process circuit having high processing power is rarely mounted in a general radio controlled timepiece.

Accordingly, it is considered that in a general radio controlled timepiece, it is hoped that a load of an operation process circuit is allocated to various data processes for realizing a high-sensitive reception when receiving a standard radio wave, while a load of the operation process circuit is not intended to be allocated to another processes such as a process for indicator display.

An object of the present invention is to provide a radio controlled timepiece which is capable of reducing a load for a process regarding an indicator display.

SUMMARY OF THE INVENTION

According to one aspect of the present invention, there is provided a radio controlled timepiece including: a radio wave receiving section which receives a standard radio wave to output a time code signal; an indicator display section which performs a display regarding a reception condition of the standard radio wave; a level change detecting section which detects a change of a signal level of the time code signal outputted from the radio wave receiving section in a predetermined detection interval in a period of 1 second; an indicator control section which controls a content of the display by the indicator display section based on a number of times that the change of the predetermined signal level detected by the level change detecting section appears; and an interval setting section which specifies the detection interval for the level change detecting section as a whole interval of the period of 1 second during a detecting process of a synchronization point in the time code signal every 1 second, and narrows the detection interval for the level detecting section to be a certain interval within the period of 1 second after a detection of the synchronization point every 1 second.

DETAILED DESCRIPTION OF THE PREFERRED EMBODIMENTS

An embodiment of the present invention will be described below with reference to the drawings.

Figure 1:
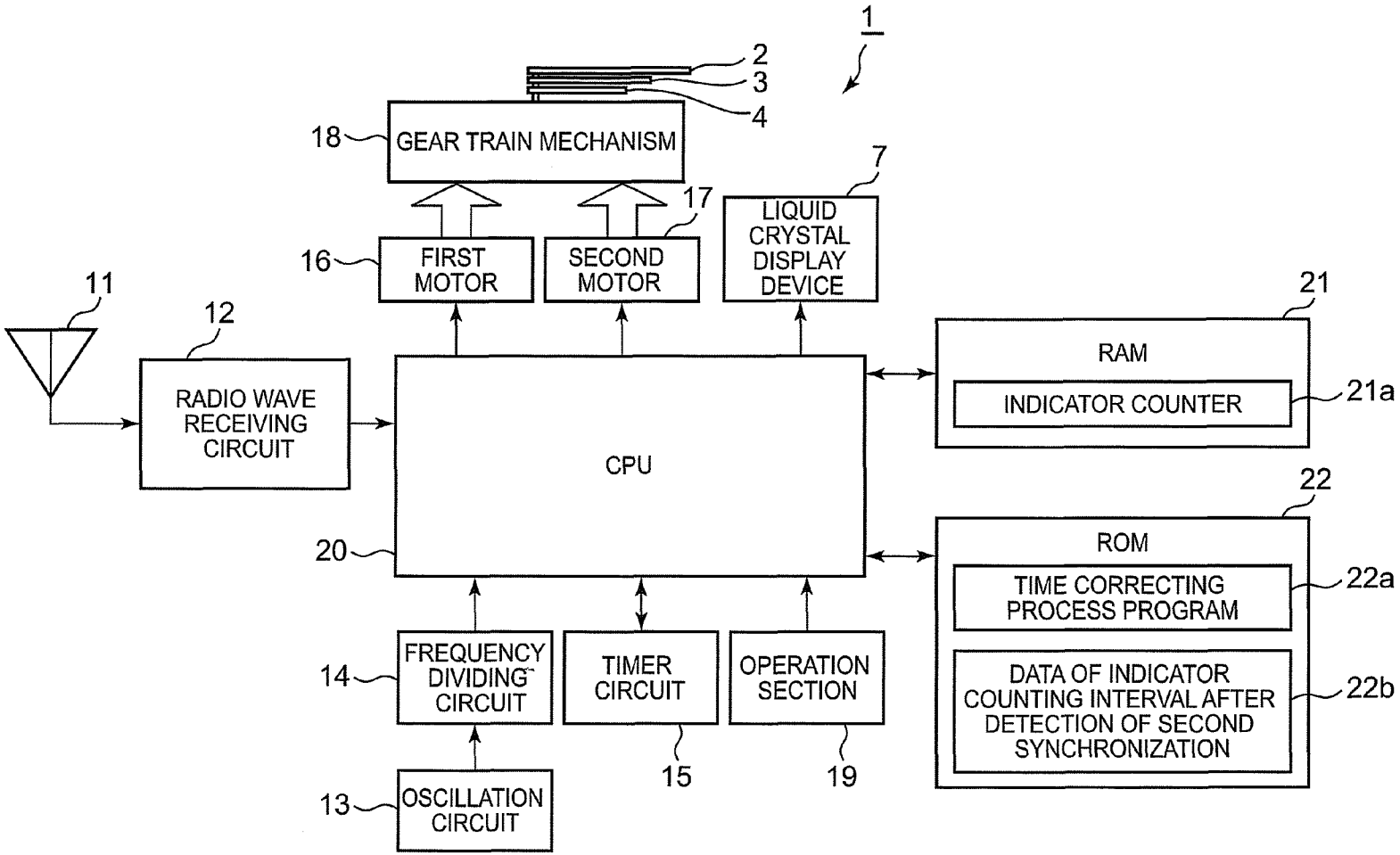
FIG. 1 is a block diagram showing an overall configuration of a radio controlled timepiece according to an embodiment of the present invention.
Figure 2:
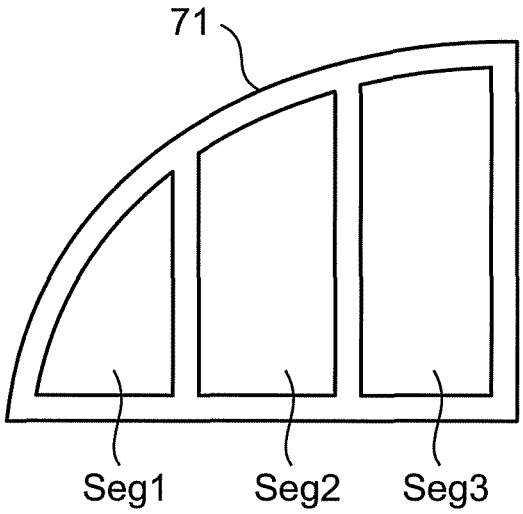
FIG. 2 is a plan view showing an indicator display section provided to a liquid crystal display device.

FIG. 1 is a block diagram showing an overall configuration of a radio controlled timepiece 1 according to an embodiment of the present invention. FIG. 2 is a plan view showing an indicator display section provided to a liquid crystal display device 7.

The radio controlled timepiece 1 of the embodiment is an electronic timepiece which has a function to receive a standard radio wave (standard time and frequency signal) including a time code to automatically correct a time. The radio controlled timepiece 1 displays a time by hands (second hand 2, minute hand 3, and hour hand 4) rotating on a face, and by a liquid crystal display device 7 which is exposed on the face to make various displays.

As shown in FIG. 1, the radio controlled timepiece 1 also includes: an antenna 11 which receives a standard radio wave; a radio wave receiving circuit (radio wave receiving section) 12 which demodulates the standard radio wave to generate a time code signal; an oscillation circuit 13 and a frequency dividing circuit 14 which generate various timing signals; a timer circuit (timer section) 15 which counts the time; a first motor 16 which drives the second hand 2 to rotate; a second motor 17 which drives the minute hand 3 and the hour hand 4 to rotate; a gear train mechanism 18 which transmits rotational driving forces of the first motor 16 and the second motor 17 to the corresponding hands; an operation section 19 which has a plurality of operation buttons and to which an operation command is inputted from the outside, a CPU (central processing unit) 20 which makes an overall control of the apparatus, a RAM (Random Access Memory) 21 which provides a working memory space to the CPU 20, and a ROM (Read Only Memory) 22 which stores various control data pieces and control programs. In the present embodiment, the CPU 20 configures a level change detecting section and an indicator control section, and the CPU 20 and an after-second-synchronization-detection indicator counting interval data 22*b* configures an interval setting section.

The liquid crystal display device 7 is equipped with an indicator display section 71 which performs a display regarding a receiving state, such as a degree of progression of the receiving process or whether or not the radio wave condition is good when receiving a standard radio wave, in addition to a time display section, as shown in FIG. 2. The indicator display section 71 has three display segments Seg1 to Seg3 for indicating a receiving state of a 0th level to a third level, for example. These three display segments Seg1 to Seg3 are configured to be capable of being turned on or off independently.

The radio wave receiving circuit 12 includes: an amplifying section which amplifies a signal received by the antenna 11; a filter section which extracts only a frequency component corresponding to the standard radio wave from the received signals; a demodulating section which demodulates the received signal whose amplitude is modulated to extract the time code signal; and a comparator which performs a wave shaping such that the demodulated time code signal is made into a signal of high-level and low-level to output the signal to the outside. Although not particularly limited, the radio wave receiving circuit 12 has a low-active output configuration in which the output becomes a low level when the amplitude of the standard radio wave is large, while the output becomes a high level when the amplitude of the standard radio wave is small.

The frequency dividing circuit 14 can change the frequency-dividing ratio into various values on receipt of the command from the CPU 20. The frequency dividing circuit 14 also has a configuration capable of providing parallel outputs of a plurality of types of timing signals to the CPU 20. For example, the frequency dividing circuit 14 generates a timing signal of 1-second period to feed the generated timing signal to the CPU 20 in order to update timer data of the counting circuit 15 in 1-second periods, while generating a timing signal of a sampling frequency to feed the generated timing signal to the CPU 20 when taking the time code signal outputted from the radio wave receiving circuit 12.

The first motor 16 and the second motor 17 are stepping motors. The first motor 16 stepwisely drives the second hand 2, and the second motor 17 stepwisely drives the minute hand 3 and the hour hand 4, independently from each other. In the normal time display state, the first motor 16 is driven one step every one second so that the second hand 2 makes one revolution in 1 minute. The second motor 17 is driven one step every 10 seconds so that the minute hand 3 makes one revolution in 60 minutes and the hour hand 4 makes one revolution in 12 hours.

The RAM 21 is equipped with an indicator counter 21*a* to be used for measuring the condition of the receiving environment of the standard radio wave. The ROM 22 stores a time correcting process program 22*a* for receiving the standard radio wave and automatically correcting a time, as one of control programs. The ROM 22 also stores the after-second-synchronization-detection indicator counting interval data 22*b*, as one of control data pieces. The indicator counting interval will be described in detail below.

Figure 3:
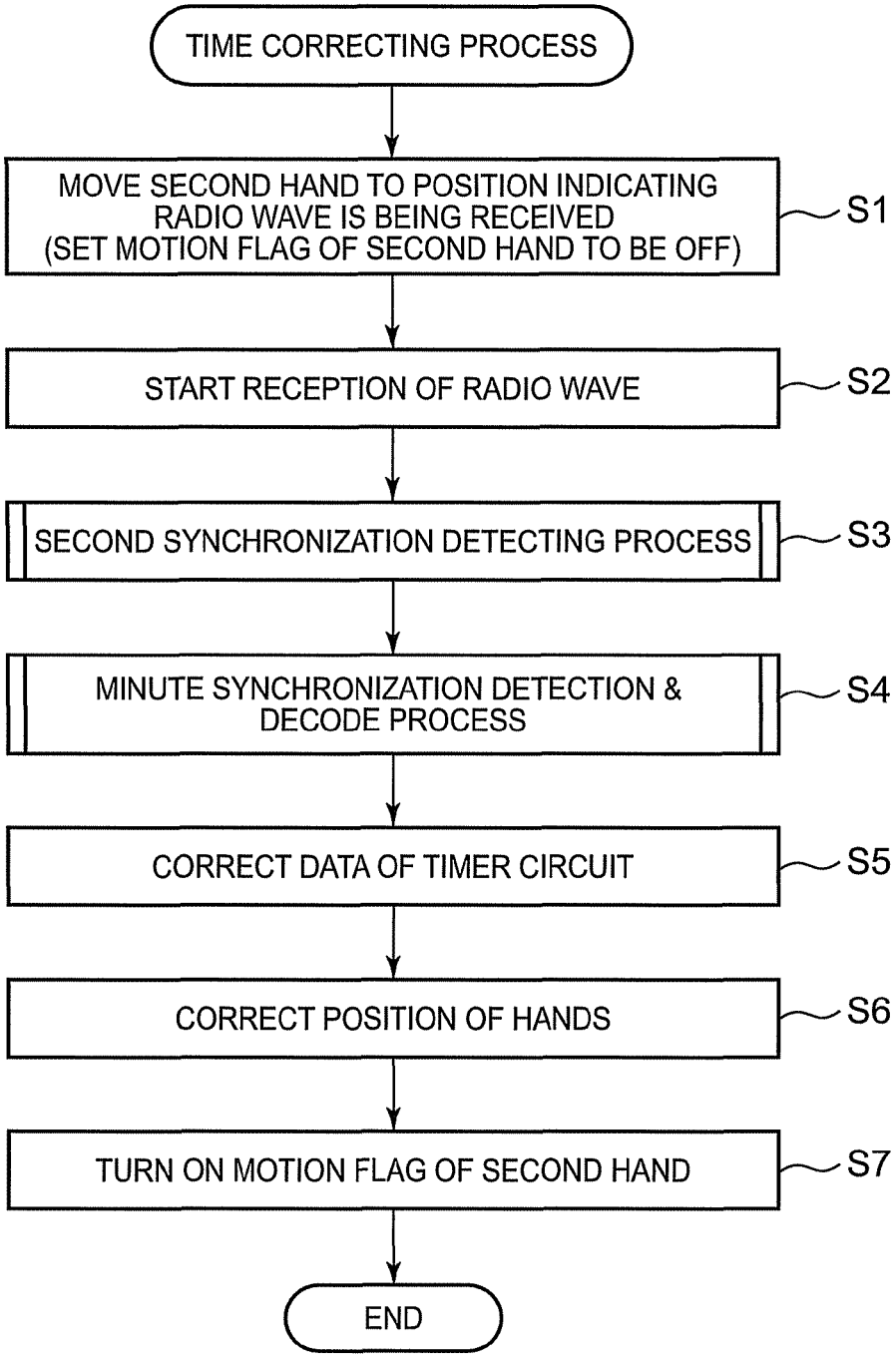
FIG. 3 is a flowchart showing a control procedure of a time correcting process executed by a CPU.

Next, the time correcting process to be executed in the radio controlled timepiece 1 having the above-mentioned configuration will be described. FIG. 3 is a flowchart showing a control procedure of the time correcting process executed by the CPU 20.

The time correcting process is started on a time which is set beforehand, or when a predetermined operation command is input through the operation section 19.

During execution of the time correcting process, a motion of the second hand 2 every 1 second is stopped, while motions of the minute hand 3 and the hour hand 4 every 10 seconds are continued. When the time correcting process is started, the CPU 20 firstly fast-forwards the second hand 2 to a position which is on the face and indicates that the radio wave is being received, and sets a motion flag of the second hand 2 in the RAM 21 to be off (step S1). With this process, the process of motion of the second hand 2 every 1 second is stopped. In addition, since the time displaying process is executed in parallel with the time correcting process, the motions of the minute hand 3 and the hour hand 4 every 10 seconds are continued.

Then, the CPU 20 operates the radio wave receiving circuit 12 so as to start the receiving process (step S2). With this process, the standard radio wave is received, whereby the time code signal represented by a high level and a low level is fed from the radio wave receiving circuit 12 to the CPU 20.

When the time code signal is fed, the CPU 20 firstly executes a second synchronization detecting process (step S3) for detecting a second synchronization point (synchronization points at 0.0 second, and at 1.0 second to 59.0 seconds) from the time code signal. During the second synchronization detecting process, also the indicator process of evaluating the receiving condition of the standard radio wave and displaying the evaluated condition is simultaneously executed. The indicator process during the second synchronization detecting process will be described in detail below.

After detecting the second synchronization point, the CPU 20 makes a code determination of the pulse signal of the time code signal on the basis of the second synchronization point, thereby executing a minute synchronization detection and decode process (step S4) which detects a minute synchronization point (a synchronization point at time of x:00 (x is an optional value) and generates time information. During the minute synchronization detection and decode process, also the indicator process of evaluating the receiving condition of the standard radio wave and displaying the evaluated condition is simultaneously executed. The indicator process during the minute synchronization detection and decode process will be described in detail below.

When the time information is acquired by the decode process, the CPU 20 corrects the timer data of the timer circuit 15 based on the time information (step S5). If needed, the minute hand 3 and the hour hand 4 are fast-forwarded so as to correct the positions of the hands (step S6). Further, the CPU turns on the motion flag of the second hand 2 to drive the stopped second hand 2 in synchronism with the timer data (step S7), and then the time correcting process ends.

Next, the indicator process to be executed in the second synchronization detecting process (step S3) and the minute synchronization detection and decode process (step S4) will be described.

Figure 4:
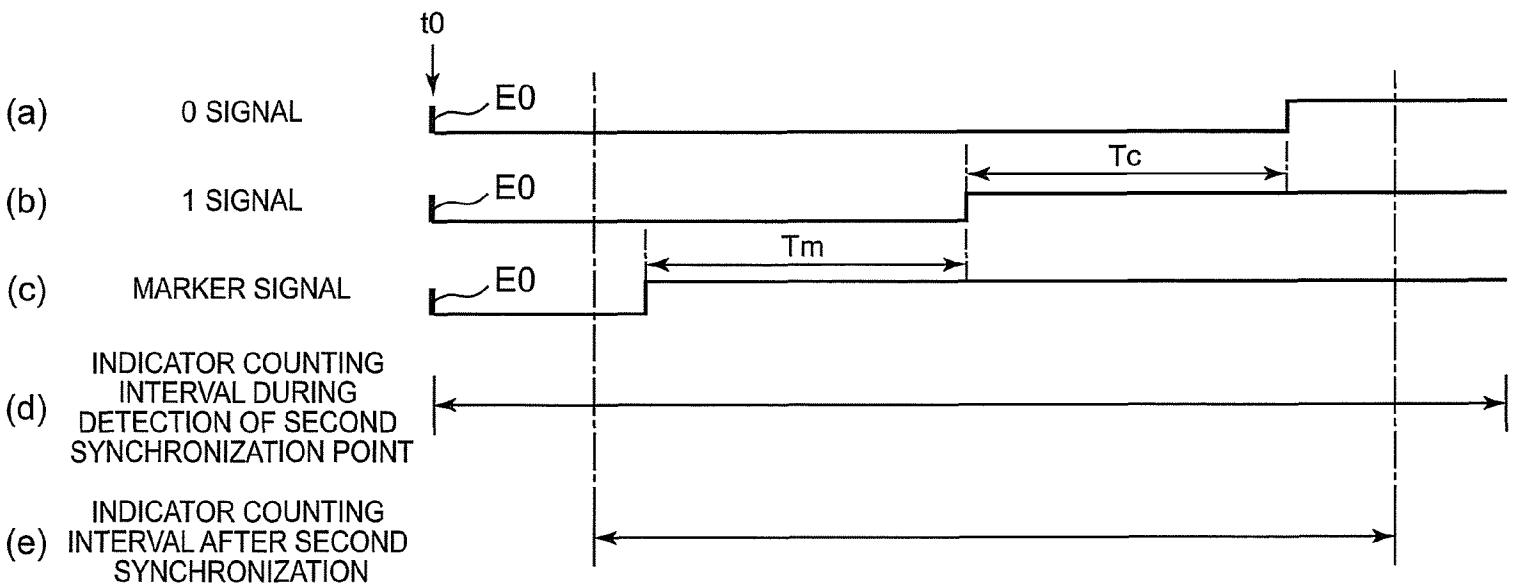
FIG. 4 is a timing chart for explaining a counting interval of an indicator process.

FIG. 4 shows a timing chart for explaining a counting interval in the indicator process.

The indicator process is executed during reception of the standard radio wave and displays the progression of the receiving process or the radio wave condition on the indicator display section 71. A user sees this display, and if the user finds that the user is in a poor receiving environment, the user can move the radio controlled timepiece 1 to a satisfactory receiving environment, and can receive the standard radio wave in this environment.

In the indicator process according to the embodiment, the CPU 20 counts the number of times that a predetermined level change appears with respect to the time code signal fed from the radio wave receiving circuit 12, and determines whether or not the radio wave condition is good based on this number of times. The CPU 20 also controls the display content of the indicator display section 71 based on the result of the determination. In the indicator process according to the embodiment, the display content of the indicator display section 71 is changed, as the stage of the receiving process progresses, whereby a user can find the degree of the progression of the receiving process.

Specifically, as shown in FIG. 4, the CPU 20 samples the time code signal with a predetermined sampling frequency (e.g., 32 Hz) so as to detect a signal level in a predetermined counting interval. The CPU calculates a change of the current signal from the last signal level so as to count how many changes same as a level change E0 (high level "H"→low level "L") at the second synchronization point t0 by using the indicator counter 21*a* in the RAM 21.

As shown in (a)-(c) of FIG. 4, the level change E0 of "H→L" in an ideal time code signal having no noise in the Japanese standard radio wave JJY appears once at the second synchronization point t0, but does not appear in other portions. Accordingly, when counting the level change of "H→L" with a period of 1 second, it is ideal that the counted value is 1. If there is noise contamination, the counted value may be 0, or 2 or more.

At the stage before the detection of the second synchronization point t0, it is unknown at which timing the level change E0 of the second synchronization point t0 appears. Therefore, as shown in (d) of FIG. 4, the whole interval of the period of 1 second is specified as the counting interval at this stage, wherein the sampling of the time code signal and the counting of the level change of "H→L" are performed within this interval. When the counted value every 1 second is "1", it can be determined that the radio wave condition is satisfactory, whereby a display of a first level indicator is performed. On the other hand, when the counted value is other than "1", it is determined that the radio wave condition is not good, whereby a display of a 0th level indicator is performed.

Here, the display of the 0th level indicator means a display embodiment in which all of the first to third display segments Seg1 to Seg3 of the indicator display section 71 in FIG. 2 are turned off, while the display of the first level indicator means a display embodiment in which only the first display segment Seg1 is turned on.

The indicator process described above is repeatedly executed during the second synchronization detecting process. When the second synchronization point t0 is normally detected, an indicator display of a second level is performed in order to show that the radio receiving process progresses at one stage. The indicator display of the second level means a display embodiment in which the first and second display segments Seg1 and Seg2 of the indicator display section 71 (FIG. 2) are turned on, but the third display segment Seg3 is turned off.

After detecting the second synchronization point t0 during the second synchronization detecting process, at which timing the level change E0 at the second synchronization point t0 appears during the period of 1 second becomes known. Therefore, as shown in (d)→(e) of FIG. 4, in the stage after detection of the second synchronization point t0, the control is made such that the counting interval of the level change of the "H→L" is narrowed to a part of the interval within the period of 1 second. The counting interval of (e) of FIG. 4 is stored beforehand in the ROM 22 as the after-second-synchronization-detection indicator counting interval data 22*b*. The data 22*b* is represented by time data with the second synchronization point t0 being defined as a reference.

As shown in (e) of FIG. 4, the counting interval after the detection of the second synchronization point t0 is set to a certain interval excluding the interval where the level change E0 of "H→L" appears in the ideal signal waveform. This interval includes a first characteristic portion Tm in which signal levels are different between the marker signal and another signals in the ideal signal waveform, and also includes a second characteristic portion Tc in which signal levels are different between the 0 signal and the 1 signal.

Since the whole interval is not specified as the counting interval, but a certain interval is specified as the counting interval, the number of times of the sampling process, the calculation of the level change, the determination of the level change, and its counting process, which are required for the indicator process, is reduced. Therefore, the load of the CPU 20 can be reduced, and further, the necessary storage capacity of the RAM 21 can be reduced.

The advantages described below can be obtained by setting the counting interval in the interval including the first characteristic portion Tm and the second characteristic portion Tc. Specifically, the sampling process needed for identifying the marker signal in the detecting process of the minute synchronization point, the sampling process needed for identifying the 0 signal and the 1 signal in the decode process, and the sampling process needed for the indicator process can concurrently be executed.

In the detection of the minute synchronization point and the decode process, a noise contamination in the first characteristic portion Tm where the difference in the signal levels appears between the marker signal and another signals and/or in the second characteristic portion Tc where the difference in the signal levels appears between the 0 signal and the 1 signal affects the progression or precision of the process, while a noise contamination in another intervals does not affect the process so much. Therefore, by setting the counting interval for the indicator process in the interval including the first characteristic portion Tm and the second characteristic portion Tc, the advantage described below can be obtained. Specifically, the deterioration degree of the signal in the portion which substantially gives an influence is determined upon executing the minute synchronization detection or the decode process, and the result can be reported to the user by the indicator display.

In the indicator process according to the embodiment, when proceeding to the stage after the detection of the second synchronization point to, the sampling of the time code signal is executed within the narrowed interval of (e) of FIG. 4E, whereby the level change of "H→L" is counted every 1-second period. When the counted value every 1 second is "0", the radio wave condition is determined to be satisfactory, whereby a display of a third level indicator is performed. Specifically, the first to third display segments Seg1 to Seg3 of the indicator display section 71 are all turned on. On the other hand, when the counted value is other than "0", the radio wave condition is determined to be no good, whereby the display of the second level indicator is performed.

The indicator process described above is repeatedly executed during the detecting process of the minute synchronization point and the decode process. After the decode process ends and the reception of the standard radio wave is stopped, the indicator process is also ended.

Next, the control procedure of the second synchronization detecting process, and the minute synchronization detection and decode process, in which the indicator process described above is executed, will be described with reference to a flowchart.

Figure 5:
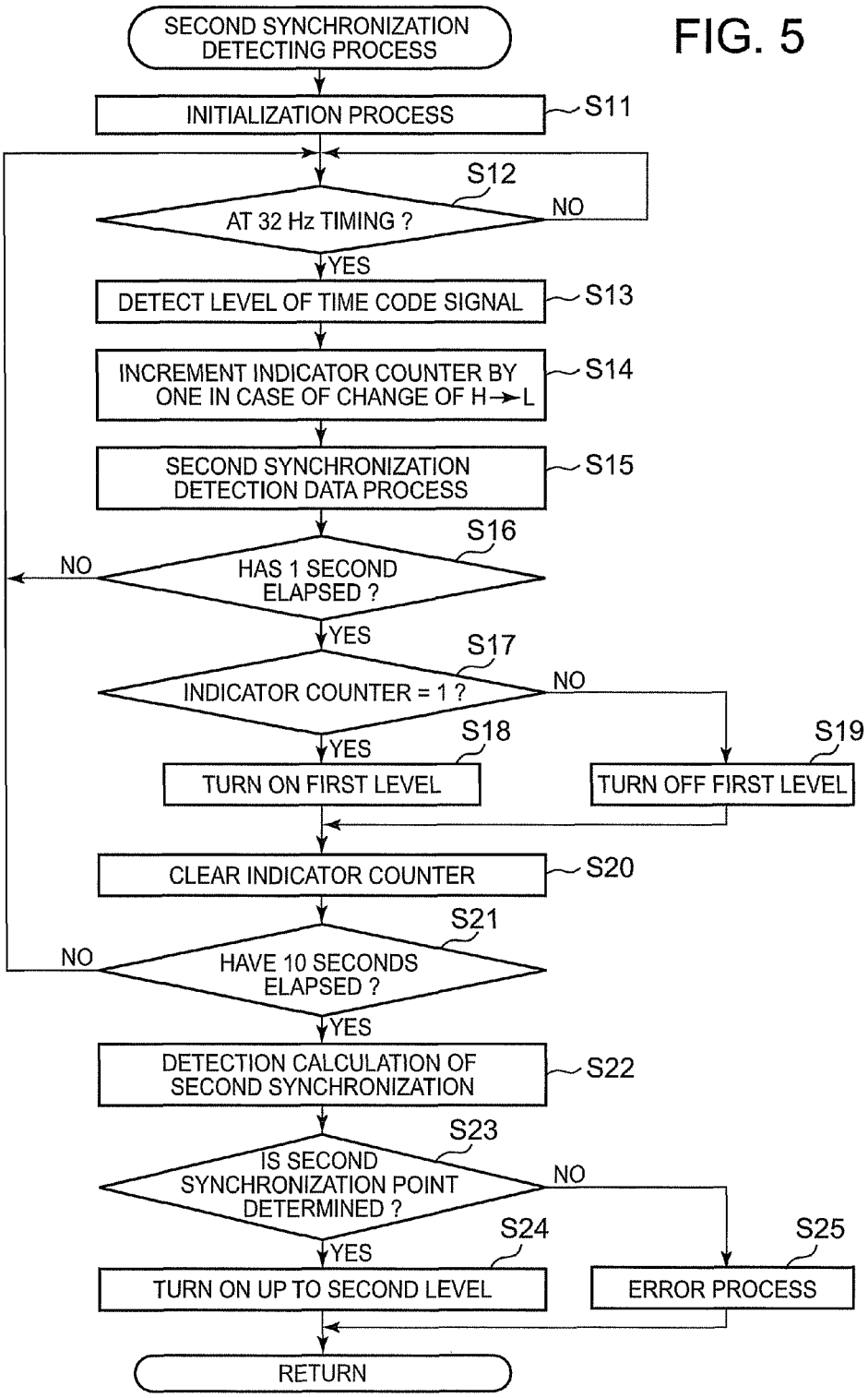
FIG. 5 is a flowchart showing a detailed control procedure of a second synchronization detecting process executed in step S3 in FIG. 3.

FIG. 5 is a flowchart showing a detailed control procedure of the second synchronization detecting process to be executed in step S3 in FIG. 3.

When proceeding to the second synchronization detecting process, the CPU 20 firstly executes an initialization process such as clearing memory areas of various variables used in this process (step S11). Then, the CPU 20 determines whether or not it is a sampling timing of 32 Hz based on the input of the timing signal from the frequency dividing circuit 14 (step S12). When it is this timing, the CPU 20 proceeds to the following step to detect the level of the time code signal (step S13: sampling section). The level detection is performed for both of counting a predetermined level change in the indicator process and detecting the second synchronization point.

When the level is detected, the CPU 20 calculates the change from the previously-detected level (change calculating section). When it is the change from the high level to the low level "→L", the CPU 20 increments the indicator counter 21*a* of the RAM 21 by "1 (one)" (step S14). The CPU 20 also executes a data process including a predetermined calculation process with respect to the detection result in step S13, and storage of the result of the operation process in a predetermined memory area (step S15), in order to detect the second synchronization point later. Various known techniques can be applied to the data process of detecting the second synchronization point, and its detailed description will not be repeated.

Then, the CPU 20 determines whether or not 1 second has elapsed based on the input of the timing signal from the frequency dividing circuit 14 (step S16). When 1 second has not elapsed, the CPU 20 returns to step S12 to repeat the loop process of steps S12 to S16.

According to the loop process of steps S12 to S16, the number of the changes "→L" of the signal level is counted on the indicator counter 21*a* over the whole interval of the period of 1 second.

On the other hand, when 1 second has elapsed, the CPU 20 proceeds to the following step to confirm the value of the indicator counter 21*a* of the RAM 21. By this, the CPU 20 determines whether or not the value is "1", which is obtained in the ideal signal waveform (step S17). When it is "1" as the result of the determination, the CPU 20 turns on the first display segment Seg1 of the indicator display section 71 (step S18). On the other hand, when it is not "1", the CPU 20 turns off the first display segment Seg1 of the indicator display section 71 (step S19). After performing the display control of the indicator display section 71, the CPU 20 clears the value of the indicator counter 21*a* (step S20). A part of an indicator control section is constituted by the processes in steps S17 to S19.

Then, the CPU 20 determines whether or not 10 seconds have elapsed after proceeding to the second synchronization detecting process (step S21). When 10 seconds have not yet elapsed, the CPU 20 returns to step 512.

On the other hand, when 10 seconds have elapsed, the CPU 20 performs an operation process of determining the second synchronization point by using the data of 10 seconds calculated and stored in step S15 (step S22). The CPU 20 then determines whether or not the second synchronization point is normally determined by this operation process (step S23). When it is normally determined, the CPU 20 turns on up to the second display segments Seg2 of the indicator display section 71 (step S24). On the other hand, when it is not normally determined, the CPU 20 proceeds to an error process (step S25). Then, the CPU 20 ends the second synchronization detecting process, and returns to the time correcting process (FIG. 2). The processes in steps S23 and 524 form a part of the indicator control section.

Specifically, the process of sampling the time code signal with the predetermined sampling frequency over the whole interval of the period of 1 second is continued for 10 seconds by the second synchronization detecting process, whereby the process of determining the second synchronization point based on the sampling data of the 10 seconds is executed. During the process of the second synchronization detection, the number of the level change "→L" is counted in the whole interval of the period of 1 second based on the result of the sampling process, whereby the indicator display according to the counted value is updated every 1 second.

Figure 6:
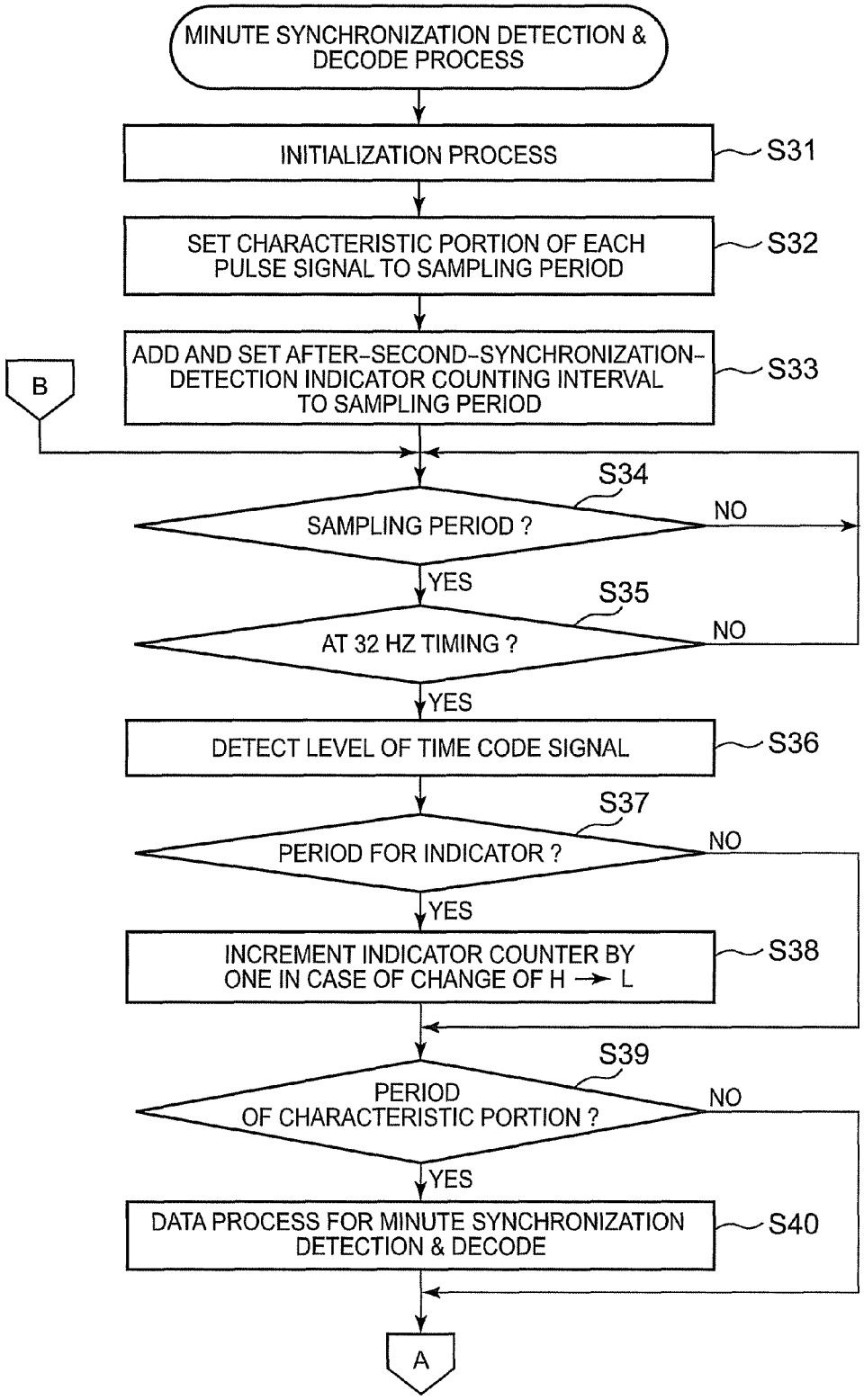
FIG. 6 is a first half of a flowchart showing a detailed control procedure of a minute synchronization detection and a decode process executed in step S4 in FIG. 3.
Figure 7:
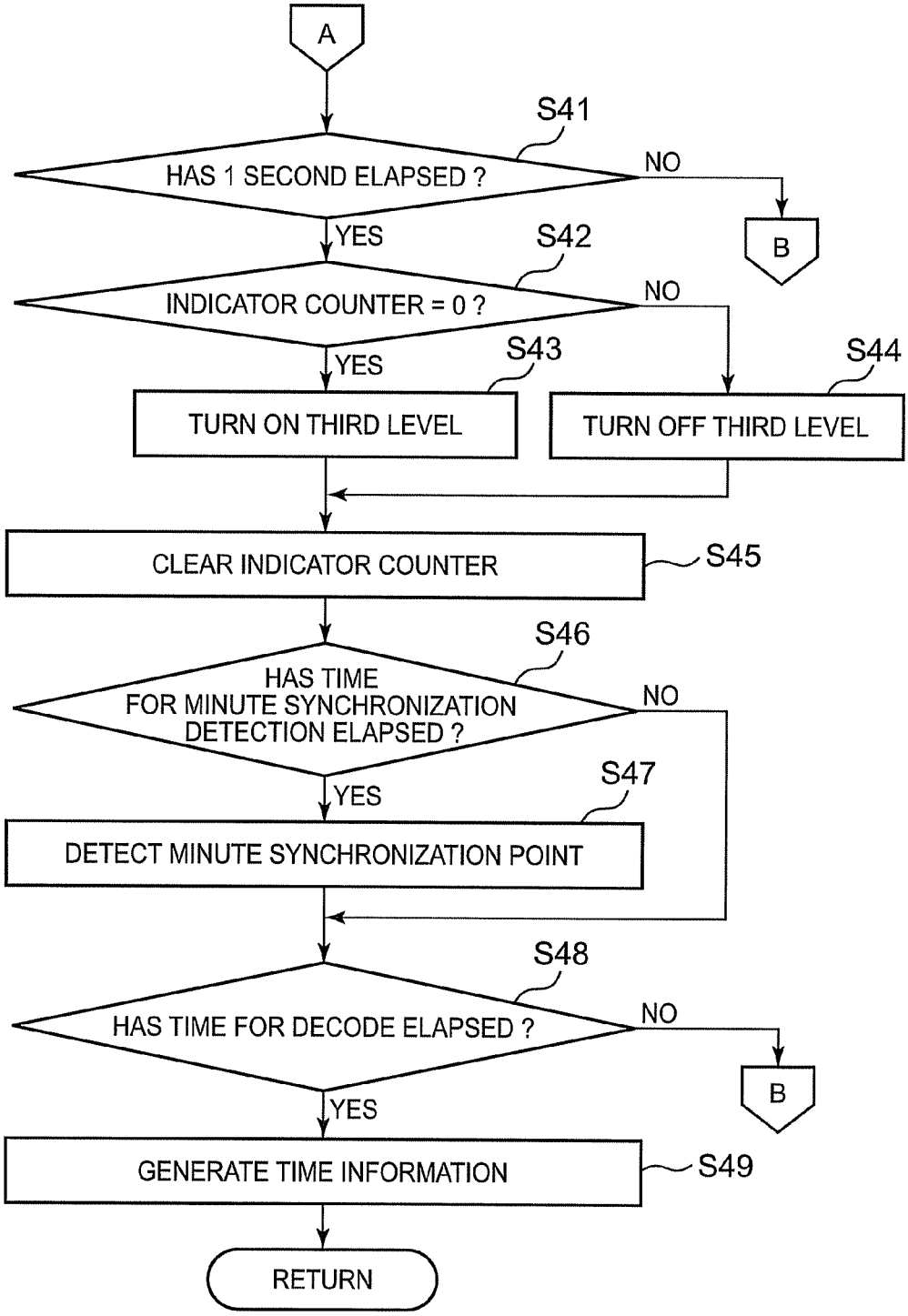
FIG. 7 is a second half of the flowchart of the minute synchronization detection and the decode process.

FIGS. 6 and 7 are flowcharts showing the detail of the minute synchronization detection and decode process executed in step S4 in FIG. 3.

When proceeding to the minute synchronization detection and decode process, the CPU 20 firstly executes an initialization process such as clearing memory areas of various variables used in this process (step S31).

The CPU 20 then sets the characteristic portion of each pulse signal forming the time code as the sampling period according to the time using the second synchronization point as a reference (step S32). The sampling period is set in order to detect the minute synchronization point and a code determination of each pulse signal for decode.

Further, the CPU 20 reads the after-second-synchronization-detection indicator counting interval data 22*b* in the ROM 22, and adds this interval to the sampling period (step S33: interval setting section). This sampling period is set in order to measure the degree of deterioration of the time code signal in the indicator process.

The CPU 20 then determines whether or not the current point corresponds to the sampling period set in steps S32 and S33 based on the counted time on the basis of the second synchronization point (step S34). When the current point corresponds to the sampling period, the CPU 20 determines whether or not it is the sampling timing of 32 Hz based on the input of the timing signal from the frequency dividing circuit 14 (step S35). When the current point corresponds to the sampling period, and at the sampling timing, the CPU 20 proceeds to the following step to detect the level of the time code signal (step s36: sampling section).

After detecting the level, the CPU 20 determines whether or not the current point is in the indicator counting interval (step S37). When it is in the counting interval, the CPU 20 calculates the change of the currently-detected signal level from the previously-detected signal level (change calculating section). When it is the change from the high level to the low level "H→L", the CPU 20 increments the indicator counter 21*a* of the RAM 21 by "1" (step S38). Then, the CPU 20 proceeds to the following step. On the other hand, when it is not in the counting interval in step S37, the CPU proceeds to the following step.

When proceeding to the following step, the CPU 20 determines whether or not the current point is in the period corresponding to the characteristic portion of the pulse signal for the code determination (step S39). When it is so, the CPU 20 executes the data processing including a predetermined calculation process with respect to the detection result in step S36, and the storage of the result of the operation process in a predetermined memory area (step S40), in order to detect the minute synchronization point and decode later. Thereafter, the CPU proceeds to the following step. On the other hand, when is determined in step S39 that the current point is not in the corresponding period, the CPU 20 proceeds to the following step. Various known techniques can be applied to the data process of detecting the minute synchronization point and the decode process of the time code signal, and its detailed description of the decode process in step S40 will not be repeated.

When the sampling period determined in step S34 corresponds to the sampling period of the characteristic portion of each pulse signal set in step S32, the detecting process of the minute synchronization point and the data process for the decode in step S40 are executed. When the sampling period corresponds to the sampling period in the indicator counting interval set in step S33, the counting process of measuring the degree of the deterioration of the signal in step S38 is executed. When the sampling period corresponds to both sampling periods, both processes are executed.

Next, the CPU 20 determines whether or not 1 second has elapsed based on the input of the timing signal from the frequency dividing circuit 14 (step S41). When 1 second has not elapsed, the CPU 20 returns to step S34 to repeat the loop process of steps S34 to S41. According to the loop process of steps S34 to S41, the number of the level changes "H→L" of the time code signal is counted on the indicator counter 21*a* in the counting interval which is narrowed to be a certain interval within the period of 1 second.

On the other hand, when it is determined that 1 second has elapsed as a result of the determination process in step S41, the CPU 20 proceeds to the following step to confirm the value of the indicator counter 21*a* of the RAM 21. By this, the CPU 20 determines whether or not the value is "0", which is obtained in the ideal signal waveform (step S42). When it is "0" as the result of the determination, the CPU 20 turns on the third display segment Seg3 of the indicator display section 71 (step S43). On the other hand, when it is not "0", the CPU 20 turns off the third display segment Seg3 of the indicator display section 71 (step S44). After performing the display control of the indicator display section 71, the CPU 20 clears the value of the indicator counter 21*a* (step S45). The processes in steps S42 to S44 form a part of the indicator control section.

Then, the CPU 20 determines whether or not it is the timing when the time for the detection of the minute synchronization point has elapsed (step S46). When it is this timing, the CPU 20 executes the process of detecting the minute synchronization point located at the position where two marker signals are arranged side by side in the time code signal by using the data calculated and stored in step S40 (step S47).

On the other hand, when the time for the detection of the minute synchronization has not elapsed, or when the detection of the minute synchronization point has been already completed over this time, the CPU 20 proceeds to the "No" side in the determination process in step S46 to determine whether or not it is the timing when the time for the decode has elapsed (step S48). When the time has not elapsed, the CPU 20 returns to step S34 so as to proceed again to the loop process of sampling the time code signal at the predetermined cycle.

On the other hand, when it is determined in the determination process in step S48 that the time for the decode has elapsed, the CPU 20 performs the code determination of the time code signal to generate the time information by using the data calculated and stored in step S40 (step S49). Then, the CPU 20 ends the minute synchronization detection and decode process, and returns to the time correcting process (FIG. 3).

Specifically, in the above-mentioned minute synchronization detection and decode process, the number of the level changes "H→L" of the time code signal is counted in the counting interval which is narrowed to be a certain interval within the period of 1 second. The indicator display is updated every 1 second according to the counted value.

As described above, according to the radio controlled timepiece 1 of the embodiment, the user can find information regarding the progression of the receiving process and/or the receiving condition such as whether or not the radio wave condition is good, by the indicator process during reception of the standard radio wave. For the indicator process, the interval in which the predetermined level change in the time code signal is counted is made to be narrowed to a certain interval within the period of 1 second after the detection of the second synchronization point. Accordingly, the number of times of the sampling process, the calculation of the level change, the determination of the level change, and its counting process, which are required for the indicator process, are reduced. Therefore, the load of the CPU 20 can be reduced, and further, the used amount of the RAM 21 can be reduced.

According to the radio controlled timepiece 1 in the embodiment, the counting interval for the indicator process is narrowed to be the interval where the change same as the level change at the second synchronization point does not appear. Accordingly, the counting interval for the indicator process is narrowed, whereby the load of the process can be reduced. Furthermore, when the level change at the second synchronization point in this counting interval is counted, it is evaluated that there is noise contamination corresponding to the counted level change.

According to the radio controlled timepiece 1 in the embodiment, the counting interval for the indicator process is narrowed to be the interval including the first characteristic portion Tm and the second characteristic portion Tc (see FIG. 4), which characterize a plurality of types of pulse signals constituting the time code signal. Accordingly, the detection of the signal level for determining the code of the pulse signal in the detecting process of the minute synchronization point and the decode process, and the detection of the signal level for measuring the degree of the deterioration of the signal in the indicator process, can be executed concurrently. Since the degree of deterioration of the signal is measured by using the important portion for identifying the pulse signal in the detecting process of the minute synchronization point and the decode process, whether or not there is the signal deterioration which substantially affects the subsequent process is represented by the indicator display.

In particular, since the counting interval for the indicator process is narrowed to be the interval including the first characteristic portion Tm which allows the marker signal and another pulse signals to be distinguished from each other, the above-mentioned operation and effect can surely be achieved, in the subsequent process of detecting the minute synchronization point.

According to the radio controlled timepiece 1 in the embodiment, the time code signal is sampled with the predetermined frequency, and the previous and following sampling results are compared to detect the change of the signal level. Accordingly, an appropriate detecting process can be realized with the process that has relatively light load.

According to the radio controlled timepiece 1 in the embodiment, the indicator displays of the 0th level and the first level are performed, depending upon the presence of noise in the time code signal, during the second synchronization detecting process. After the second synchronization point is normally detected, the indicator display of the second level is performed. Thereafter, the indicator displays of the second level and the third level are performed according to the presence of the noise in the time code signal. Specifically, the user can find appropriate notification regarding the radio wave condition by the display described above.

The present invention is not limited to the above embodiment and can be adequately changed. For example, the manner of narrowing the counting interval for the indicator process is not limited to the one shown in (d)→(e) of FIG. 4.

Figure 8:
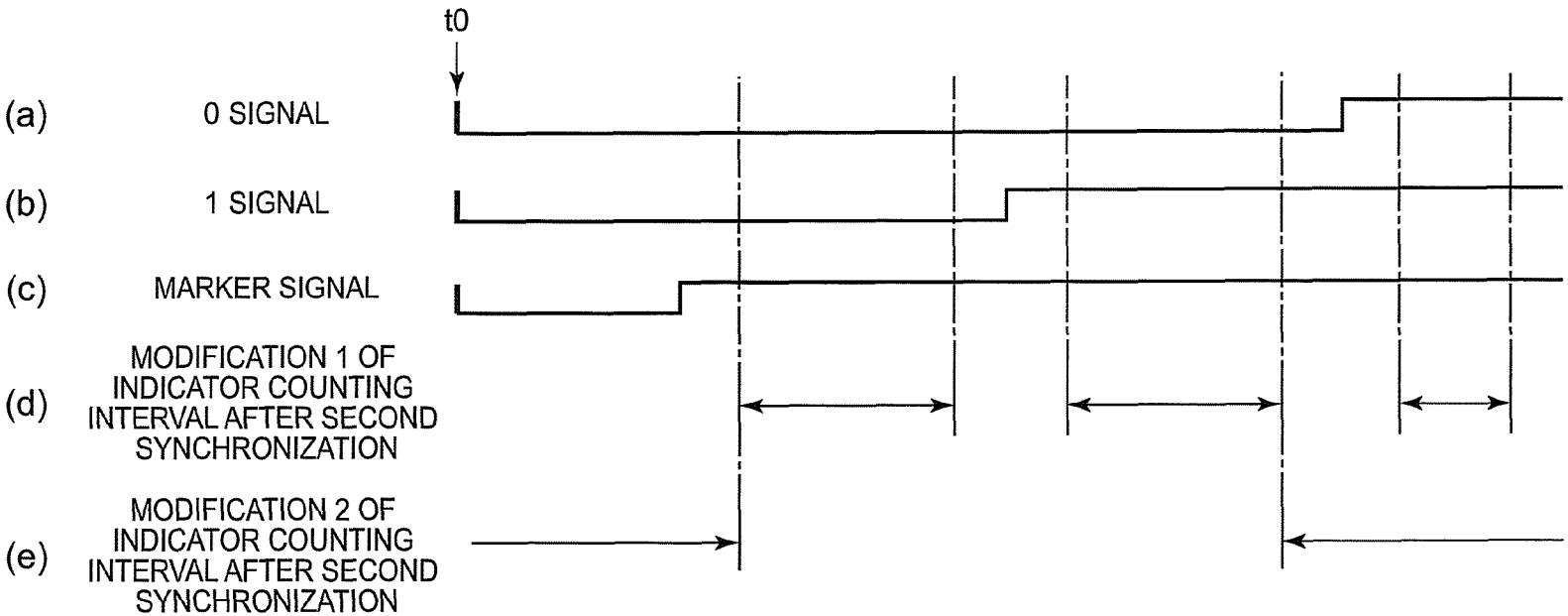
FIG. 8 is a time chart showing a modification of a counting interval of the indicator process.

FIG. 8 is a view showing a modification of the counting interval for the indicator process. For example, the counting interval for the indicator process may be narrowed to the interval which is divided into a plurality of intervals as shown in (d) of FIG. 8. The counting interval is the one where the change same as the level change at the second synchronization point t0 does not appear in the ideal signal waveform, and the characteristic portion of the signal is included, as in the case of (e) of FIG. 4. As shown in (e) of FIG. 8, the counting interval may be narrowed to be the interval where the level change at the second synchronization point t0 may appear once in the ideal signal waveform. Even in the interval described above, the number of times of the level change of "H→L" is counted, whereby it can be determined whether the signal has a waveform close to the ideal signal waveform or it is contaminated with noise, from the counted value.

Figure 9:
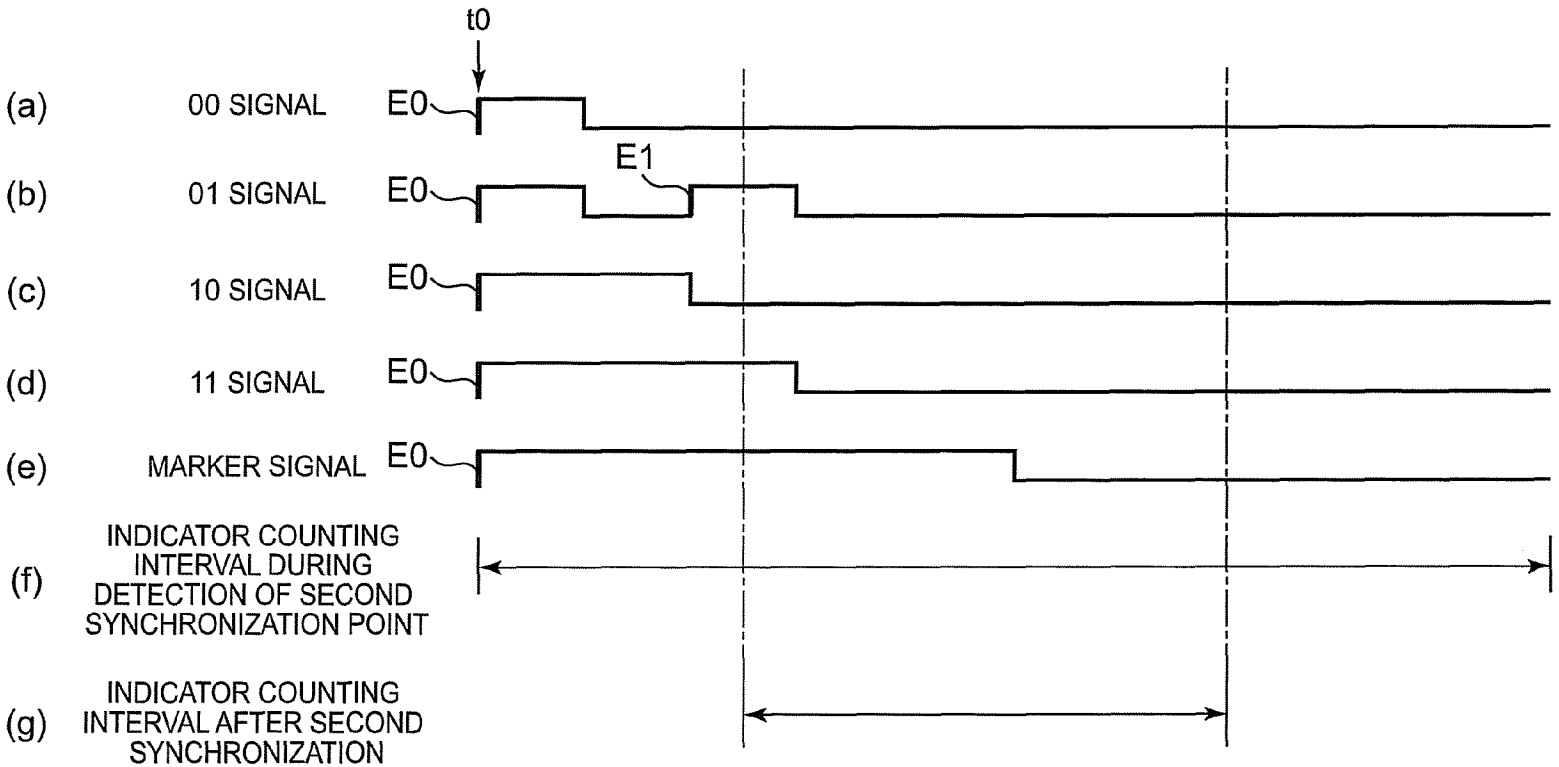
FIG. 9 is a timing chart for explaining one example of a counting interval of the indicator process corresponding to British standard radio wave MSF.

FIG. 9 is a timing chart for explaining one example of a counting interval for an indicator process corresponding to the British standard radio wave MSF. In the British standard radio wave MSF, the change same as the level change E0 of "L→H" at the second synchronization point t0 appears at the other portions in 01 signal of (b) of FIG. 9. Accordingly, when the counting interval for the indicator process is narrowed to be the interval where the level change same as that at the second synchronization point t0 in the ideal signal waveform does not appear, with respect to the time code signal described above, the counting interval after the second synchronization detection may be set to be the interval which does not include the portion of the level changes E0 and E1 of "L→H" of the 01 signal, as shown in (g) of FIG. 9.

In the radio controlled timepiece 1 according to the embodiment, the change same as the level change at the second synchronization point is counted in order to evaluate the degree of deterioration of the time code signal in the indicator process. However, the change reverse to the level change at the second synchronization point may be counted, or both level changes may be counted.

In the radio controlled timepiece 1 according to the embodiment, the time code signal is specified as a binary signal having a high level and a low level. However, the demodulated time code signal may be outputted from the radio wave receiving circuit 12 in an analog form, and the resultant may be converted into a multilevel digital signal by an AD converter. Then, the converted digital signal may be taken by the CPU 20 so as to detect the change of the signal level. The method of detecting the level change is not limited to the method of comparing the previous and following signal levels through the sampling of the signal levels. For example, it can be configured such that, when the signal level is changed, a hardware interrupt is caused, and the CPU 20 detects the level change by this interruption.

In the radio controlled timepiece 1 according to the embodiment, the counting of the level change and the update of the indicator display based on the counted value are executed by one second. However, they may be executed by a plurality of seconds. The detail described in this embodiment can appropriately be modified without departing from the scope of the present invention.

All of the disclosures including the patent specification, the claims, the attached drawings and the abstract of Japanese Patent Application No. 2010-158351 filed on Jul. 13, 2010 are herein incorporated by reference.

What is claimed is:

1. A radio controlled timepiece comprising:

a radio wave receiving section which receives a standard radio wave to output a time code signal;

an indicator display section which performs a display regarding a reception condition of the standard radio wave;

a level change detecting section which detects a change of a signal level of the time code signal outputted from the radio wave receiving section in a predetermined detection interval in a period of 1 second;

an indicator control section which controls a content of the display by the indicator display section based on a number of times that the change of the predetermined signal level detected by the level change detecting section appears; and an interval setting section which specifies the detection interval for the level change detecting section as a whole interval of the period of 1 second during a detecting process of a synchronization point in the time code signal every 1 second, and narrows the detection interval for the level detecting section to be a certain interval within the period of 1 second after a detection of the synchronization point every 1 second.

2. The radio controlled timepiece according to claim 1, wherein the interval setting section narrows the detection interval to be an interval where a change same as a change of the signal level at the synchronization point does not appear in an ideal time code signal, after the detection of the synchronization point every 1 second.

3. The radio controlled timepiece according to claim 2, wherein the interval setting section narrows the detection interval to be an interval which includes a signal characteristic portion where signal levels of at least two types of pulse signals constituting the time code signal are different from each other in the ideal time code signal, after the detection of the synchronization point every 1 second.

4. The radio controlled timepiece according to claim 2, wherein the interval setting section narrows the detection interval to be an interval which includes a signal characteristic portion where signal levels of a marker signal indicating a frame position of the time code signal and another pulse signal among a plurality of types of the pulse signals constituting the time code signal are different from each other in the ideal time code signal, after the detection of the synchronization point every 1 second.

5. The radio controlled timepiece according to claim 1, wherein the interval setting section narrows the detection interval to be an interval where a change of the signal level at the synchronization point appears only once in an ideal time code signal, after the detection of the synchronization point every 1 second.

6. The radio controlled timepiece according to claim 1, wherein the level change detecting section includes:

a sampling section which detects the signal level of the time code signal at a predetermined sampling interval within the detection interval; and a change calculating section which compares the signal level detected by the sampling section with a previously-detected signal level or a later-detected signal level to calculate the change of the signal level.

7. The radio controlled timepiece according to claim 1, wherein the indicator control section performs:

a display of a 0th level indicating that the receiving condition is not good when the number of times that the change of the signal level at the synchronization point appears is not same as a number of times that the same change would appear in an ideal signal waveform, during the process of detecting the synchronization point every 1 second;

a display of a first level indicating that the receiving condition is better than the receiving condition in the case of the 0th level, when the number of times that the change of the signal level at the synchronization point appears is same as a number of times that the same change would appear in an ideal signal waveform, during the process of detecting the synchronization point every 1 second;

a display of a second level indicating that the receiving condition progresses more than the case of the first level, when the process of detecting the synchronization point every 1 second is executed, the display of the second level, when the number of times that the change of the signal level at the synchronization point appears in the narrowed detection interval is not same as the number of times that the same change would appear in the narrowed detection interval in an ideal signal waveform, during the process of identifying a code of the pulse signal of the time code signal after the detection of the synchronization point every 1 second; and a display of a third level indicating that the receiving condition is better than the receiving condition in the case of the second level, when the number of times that the change of the signal level at the synchronization point appears in the narrowed detection interval is same as the number of times that the same change would appear in the narrowed detection interval in an ideal signal waveform, during the process of identifying a code of the pulse signal of the time code signal after the detection of the synchronization point every 1 second.

* * * * *